US007832829B2

(12) United States Patent
Matsuda

(10) Patent No.: US 7,832,829 B2
(45) Date of Patent: Nov. 16, 2010

(54) INK JET RECORDING APPARATUS HAVING A PROTRUDING PORTION THAT COMES INTO CONTACT WITH A DROPLET RECEIVING PORTION TO CLOSE A SPACE AROUND NOZZLES FOR DISCHARGING INK

(75) Inventor: Masashi Matsuda, Hachioji (JP)

(73) Assignee: Olympus Corporation, Tokyo (JP)

( * ) Notice: Subject to any disclaimer, the term of this patent is extended or adjusted under 35 U.S.C. 154(b) by 929 days.

(21) Appl. No.: 11/712,888

(22) Filed: Mar. 1, 2007

(65) Prior Publication Data

US 2007/0206047 A1 Sep. 6, 2007

(30) Foreign Application Priority Data

Mar. 2, 2006 (JP) ..... 2006-056488

(51) Int. Cl.
*B41J 2/165* (2006.01)

(52) U.S. Cl. ..... 347/29; 347/30; 347/34; 347/36

(58) Field of Classification Search ..... 347/22, 347/25, 20–30, 32, 34
See application file for complete search history.

(56) References Cited

U.S. PATENT DOCUMENTS 7,490,921 B2 * 2/2009 Hashi et al. ..... 347/29

FOREIGN PATENT DOCUMENTS

JP 5-131639 A 5/1993
JP 7-214794 A 8/1995

* cited by examiner

*Primary Examiner*—Juanita D Stephens
(74) *Attorney, Agent, or Firm*—Holtz, Holtz, Goodman & Chick, PC

(57) ABSTRACT

A protruding member is provided on a recording head side, a droplet receiving portion having a flat surface portion formed thereon is provided, and the flat surface portion of the droplet receiving portion is brought into contact with the protruding member on the recording head side to cap the recording head.

21 Claims, 8 Drawing Sheets

INK JET RECORDING APPARATUS HAVING A PROTRUDING PORTION THAT COMES INTO CONTACT WITH A DROPLET RECEIVING PORTION TO CLOSE A SPACE AROUND NOZZLES FOR DISCHARGING INK

CROSS-REFERENCE TO RELATED APPLICATIONS

This application is based upon and claims the benefit of priority from prior Japanese Patent Application No. 2006-056488, filed Mar. 2, 2006, the entire contents of which are incorporated herein by reference.

BACKGROUND OF THE INVENTION

1. Field of the Invention

The present invention relates to an image recording apparatus in which maintenance of a recording head that discharges ink is improved.

2. Description of the Related Art

An inkjet recording apparatus generally discharges ink from each nozzle in a recording head to record (print), e.g., an image on a recording medium. In the inkjet recording apparatus, maintenance is performed to prevent each nozzle from being clogged with the ink. The maintenance must be carried out periodically or in accordance with the number of recorded sheets of the recording medium.

For example, when the recording apparatus is not used for a long time, ink that has adhered to each nozzle in the inkjet recording head is dried. As a result, clogging of each nozzle may not be eliminated even if the maintenance is performed. The ink must be prevented from drying by shielding each nozzle from outside air in order to avoid clogging of each nozzle.

FIG. 15 shows a cap member that prevents ink in a recording head from drying. A plate 101 formed by using SUS is provided to a recording head 100. A plurality of nozzles 102 are formed in, e.g., a line on a surface of the plate 101. A camp member 103 is in contact with the surface of the plate 101 of the recording head 100. The cap member 103 is obtained by integrally forming a cap bottom surface portion 104 and a lip portion 105 provided on the cap bottom surface portion 104. The lip portion 105 is formed to protrude on an entire circumference of an edge of the cap bottom surface portion 104. The cap member 103 brings the lip portion 105 into contact with the surface of the plate 101 of the recording head 100 to hermetically seal the surface of the plate 101. As a result, the cap member 103 shields each nozzle 102 from outside air to prevent ink from drying.

Besides, e.g., Jpn. Pat. Appln. KOKAI Publication No. 1993-131639 discloses a technology of preventing ink in a recording head from drying. Jpn. Pat. Appln. KOKAI Publication No. 1993-131639 discloses a cap member in an inkjet recording apparatus. A suction path through which ink is led by suction and a sealing portion having a sealing holding groove formed therein are provided to the cap member. An annular sealing member, separately prepared, is attached to the sealing holding groove of the sealing portion. The sealing member is formed by using an elastic member. In the cap member having this structure, the sealing portion (sealing member) is in contact with the ink discharge surface of a recording head. With this structure, the ink discharge surface of the recording head is hermetically sealed with the sealing portion of the cap member, and the ink is prevented from evaporating.

BRIEF SUMMARY OF THE INVENTION

According to a first aspect of the present invention, there is provided an image recording apparatus comprising: at least one recording head having a plurality of nozzles that discharge ink; a protruding member provided on the recording head side; and a droplet receiving portion on which a flat surface portion that comes into contact with the protruding member is formed and which receives the ink dropping from the recording head, wherein the plurality of nozzles are covered with a hermetically closed space formed by contact of the protruding member and the flat surface portion.

DETAILED DESCRIPTION OF THE INVENTION

An embodiment according to the present invention will now be explained hereinafter with reference to the accompanying drawings.

Figure 1:
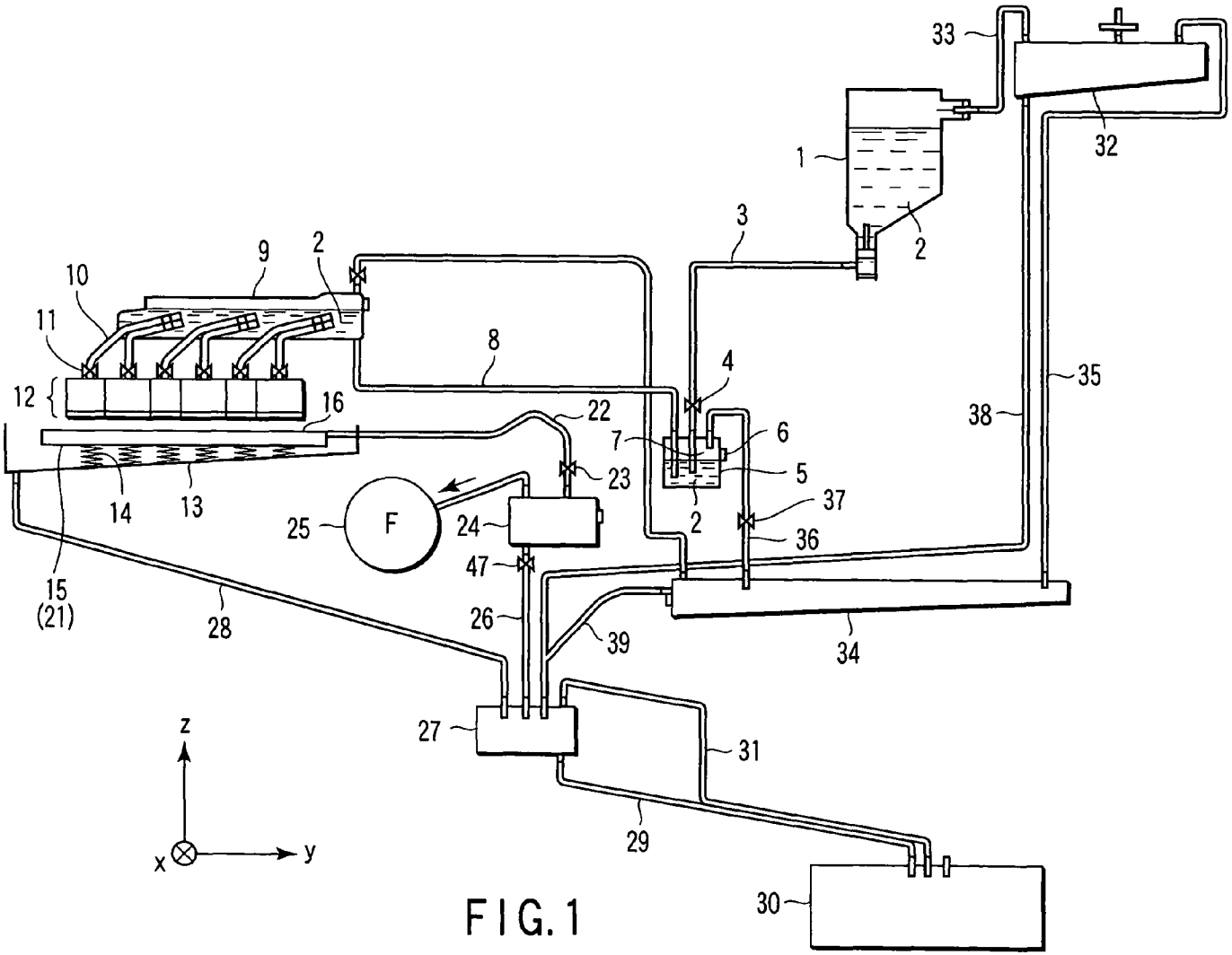
FIG. 1 is a block diagram showing an embodiment of an image recording apparatus according to the present invention.

FIG. 1 is a block diagram of an ink system in an image recording apparatus according to an embodiment of the present invention. This apparatus uses inks of respective colors, i.e., black (K), cyan (C), magenta (M), and yellow (Y). This apparatus includes a plurality of ink paths for the respective colors, i.e., a K color, a C color, an M color, and a Y color. It is to be noted that FIG. 1 shows one ink path for, e.g., the K color in order to avoid complication of the drawing. An ink tank 1 accommodates an ink 2 of the K color. An ink path tube 3 is connected with a lower part of the ink tank 1. An open valve 4 is provided to the ink path tube 3. The ink path tube 3 is arranged to downwardly bend. A lower end opening of the ink path tube 3 is immersed in the ink 2 accommodated in a sub-ink tank 5.

A sensor 6 is disposed on the sub-ink tank 5. The sensor 6 detects that the amount of ink 2 supplied from the ink tank 1 to the sub-ink tank 5 has reached a fixed value. As a result, the fixed amount of ink 2 is accommodated in the sub-ink tank 5. At this time, a space 7 is formed at an upper part in the sub-ink tank 5. An ink supply tube 8 is provided to the sub-ink tank 5. One end opening of the ink supply tube 8 is immersed in the ink 2 accommodated in the sub-ink tank 5. The other end opening of the ink supply tube 8 is connected with an ink distributor 9.

A plurality of recording heads 12 are connected with the ink distributor 9 through respective ink inflow paths 10 and respective connecting portions 11. Each ink inflow path 10 supplies the ink 2 in the ink distributor 9 to each recording head 12. Each connecting portion 11 enables connection and disconnection between the ink distributor 9 and each recording head 12.

As shown in FIG. 1, the respective recording heads 12 are arranged in a zigzag pattern in such a manner that their ends partially overlap each other over a width of a recording medium in a Y-axis direction. As a result, no gap is formed in an image that is recorded on the recording medium at the time of image recording. A plurality of nozzles are formed on a lower surface of each recording head 12. The plurality of nozzles are arranged in, e.g., one line. Each nozzle discharges the ink 2. Therefore, when the recording medium, e.g., a recording paper sheet is carried to, e.g., a space below each recording head 12, the recording medium is spotted with the ink 2 discharged from each nozzle in each recording head 12. As a result, an image is recorded on the recording medium.

An ink pan 13 is provided below the respective recording heads 12. The ink pan 13 receives the ink 2 dropping from the respective recording heads 12. A head cap portion 15 as a droplet receiving portion is provided in the ink pan 13. A plurality of elastic members 14, e.g., springs support the head cap portion 15. A flat surface portion 16 is formed on a surface of the head cap portion 15 facing the respective recording heads 12.

Figure 2:
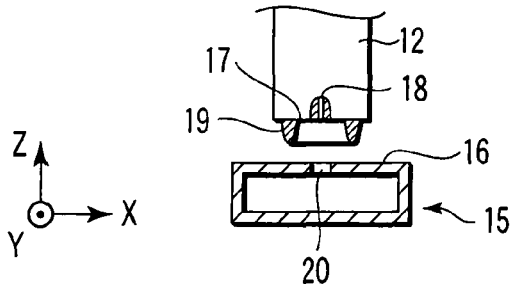
FIG. 2 is a schematic block diagram showing a first embodiment of a recording head and a head cap portion in the apparatus.

FIG. 2 is a block diagram showing the recording head 12 and the head cap portion 15. A nozzle surface 17 is formed on a lower surface of the recording head 12. A plurality of nozzles 18 that discharge the ink 2 are formed in, e.g., a linear pattern on the nozzle surface 17. A protruding member 19 formed of an elastic member is provided on the nozzle surface 17 of the recording head 12. The protruding member 19 is provided along an outer rim of the nozzle surface 17 of the recording head 12. The protruding member 19 is formed into a continuous convex shape surrounding the plurality of nozzles 18. A suction hole 20 is provided in the flat surface portion 16 of the head cap portion 15.

In such a structure, the head cap portion 15 is brought into contact with the recording head 12 (the protruding member 19). As a result, the nozzle surface 17 of the recording head 12, the protruding member 19, and the flat surface portion 16 form a hermetically closed space. Each nozzle 18 of the recording head 12 is covered with this hermetically closed space. Therefore, each nozzle 18 of the recording head 12 is capped with the head cap portion 15.

Figure 3A:
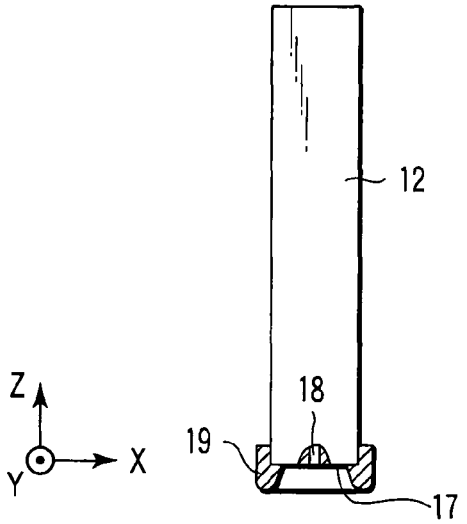
FIG. 3A is a block diagram of a front surface side showing a specific structure of the recording head in the apparatus.
Figure 3B:
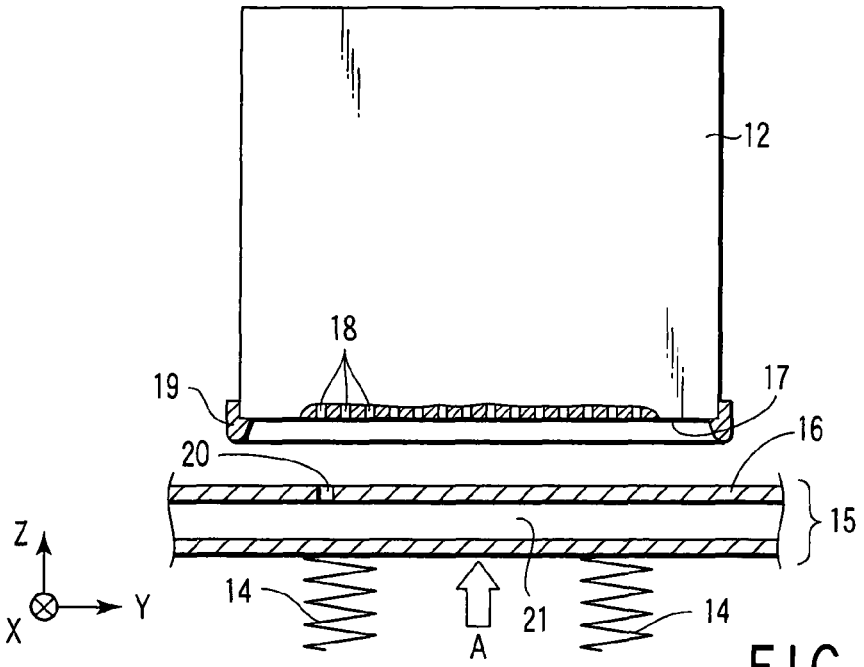
FIG. 3B is a block diagram of side surfaces showing a specific structure of the recording head and the head cap portion in the apparatus.

FIG. 3A is a block diagram of a front surface side showing a specific example of the recording head 12. FIG. 3B is a block diagram of side surfaces showing a specific example of the recording head 12 and the head cap portion 15. The protruding member 19 is provided on the nozzle surface 17 of the recording head 12. The protruding member 19 is formed of an elastic member. The protruding member 19 is provided to cover an entire periphery of an outer rim of the nozzle surface 17.

The flat surface portion 16 is formed on the head cap portion 15 to face the nozzle surface 17 of the recording head 12. The flat surface portion 16 is provided substantially parallel to the nozzle surface 17 of the recording head 12. The flat surface portion 16 is formed of a rigid body. The flat surface portion 16 is formed to have an area wider than that of a region where the protruding member 19 is provided. As a result, the flat surface portion 16 is formed to have an area that enables connection with the protruding member 19. The suction hole 20 is provided in the flat surface portion 16 of the head cap portion 15. The suction hole 20 is provided at each position corresponding to each recording head 12. A suction path 21 is provided in the head cap portion 15. The suction hole 20 communicates with the suction path 21.

The plurality of elastic members 14 are provided on the lower surface of the head cap portion 15 as shown in FIGS. 1 and 3B. Each elastic member 14 urges the head cap portion 15 in a direction indicated by an arrow A, i.e., toward the nozzle surface 17 of the recording head 12.

A maintenance mechanism will now be explained. As shown in FIG. 1, a suction tube 22 is connected with the suction path 21 of the head cap portion 15. An electromagnetic valve 23 is connected with the suction tube 22. The other end of the suction tube 22 is connected with a suction chamber 24. A suction pump 25 is connected with the suction chamber 24. The suction pump 25 draws air.

A waste liquid tube 26 as a waste liquid system is connected with a bottom portion of the suction chamber 24. The waste liquid tube 26 is connected with a sub-waste ink tank 27 through an electromagnetic valve 47. A waste liquid tube 28 is connected with the sub-waste ink tank 27. The waste liquid tube 28 is connected with a bottom portion of the ink pan 13. The waste liquid tube 28 supplies a waste liquid of the ink 2 that has dropped into the ink pan 13 from each recording head 12 to the sub-waste ink tank 27 in the form of natural drop. One end opening of a waste liquid tube 29 is connected with a bottom part of the sub-waste ink tank 27. The other end opening of waste liquid tube 29 is connected with a waste ink tank 30. An overflow tube 31 is provided between an upper part of the sub-waste ink tank 27 and the waste ink tank 30.

A filter unit 32 as the waste liquid system is provided above the ink tank 1. An upper part of the filter unit 32 is connected with the upper part of the ink tank 1 via a tube 33. An overflow tank 34 is provided below the sub-ink tank 5. The upper part of the filter unit 32 is connected with an upper part of the overflow tank 34 via a tube 35. An upper part of the sub-ink tank 5 is connected with the upper part of the overflow tank 34 via a tube 36. A valve 37 is provided on the tube 36. A bottom part of the filter unit 32 is connected with a upper part of the sub-waste ink tank 27 via a tube 38. One end opening of a tube 39 is connected with the tube 38. The other end opening of the tube 39 is connected with the overflow tank 34.

Figure 4:
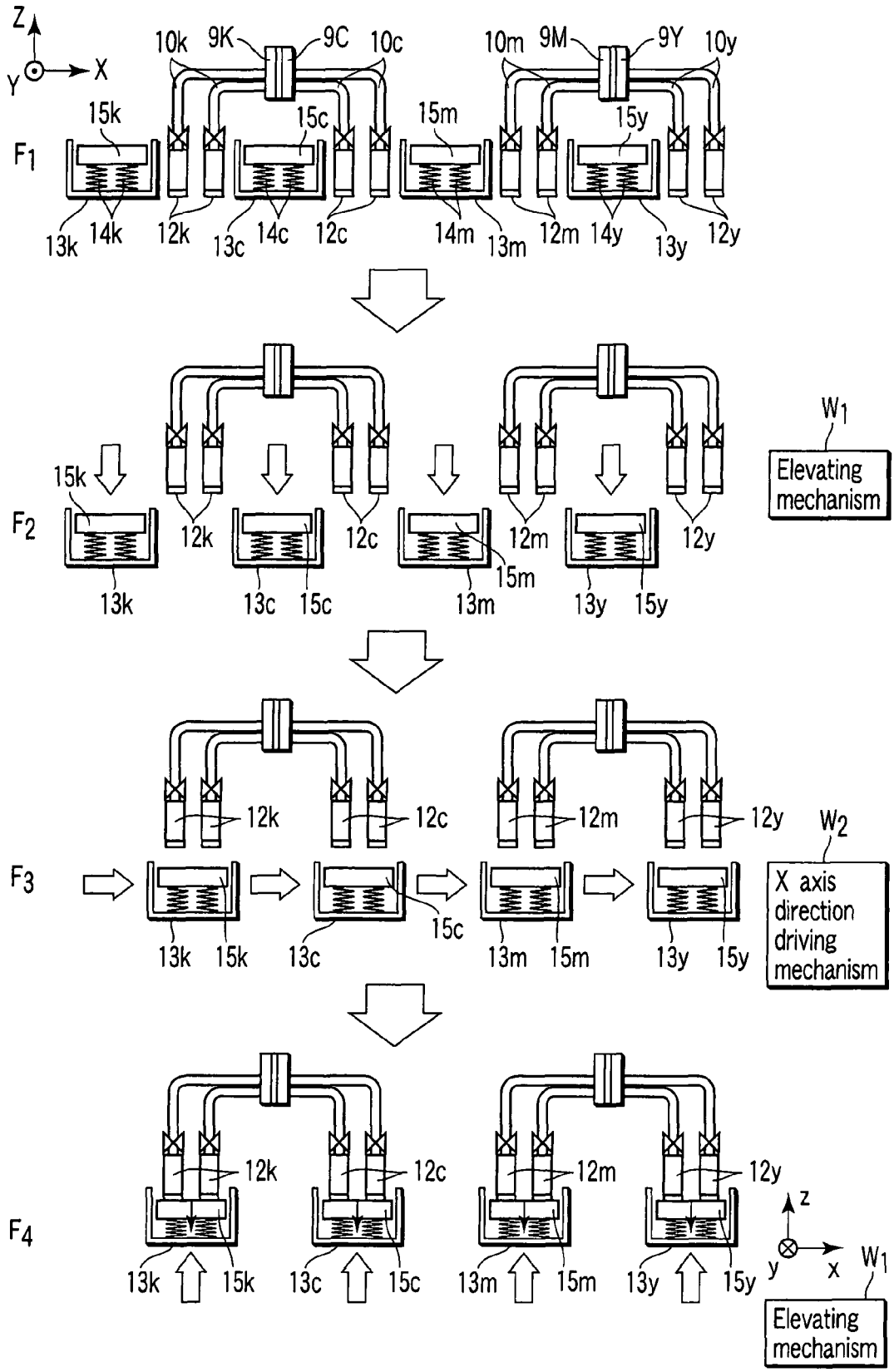
FIG. 4 is a view showing a flow of a maintenance operation in the apparatus.

A maintenance operation by the maintenance mechanism of each recording head 12 will now be explained with reference to a flowchart of a maintenance operation depicted in FIG. 4. FIG. 4 is a view showing the recording head 12 of each color from a Y-axis direction in FIG. 1. Since the recording heads 12 of the respective colors are arranged in a zigzag pattern, they can be seen as shown in FIG. 4. It is to be noted that reference numbers denote respective parts at a maintenance step $F_1$ in the drawing, reference numbers designate primary parts alone at maintenance steps $F_2$ to $F_4$ to avoid complexity, thereby omitting other reference numbers.

For example, an ink distributor 9*k* for the K color and an ink distributor 9*c* for the C color are integrally provided. An ink distributor 9*m* for the M color and an ink distributor 9*y* for the Y color are integrally provided. A recording heads 12*k* are respectively connected with the ink distributor 9*k* via a respective ink inflow paths 10*k*. A recording heads 12*c* are respectively connected with the ink distributor 9*c* via a respective ink inflow paths 10*c*. A recording heads 12*m* are respectively connected with the ink distributor 9*m* via a respective ink inflow paths 10*m*. A recording heads 12*y* are respectively connected with the ink distributor 9*y* via a respective ink inflow paths 10*y*.

In the maintenance operation, a respective ink pans 13*k*, 13*c*, 13*m*, and 13*y* for K, C, M, and Y are provided at positions where they face the respective recording heads 12. A head cap portions 15*k*, 15*c*, 15*m* and 15*y* are respectively provided on the ink pans 13*k*, 13*c*, 13*m*, and 13*y*. The respective head cap portions 15*k*, 15*c*, 15*m*, and 15*y* are supported by a respective elastic members 14*k*, 14*c*, 14*m*, and 14*y*.

An elevating mechanism $W_1$ moves up and down the respective ink pans 13*k*, 13*c*, 13*m*, and 13*y* in a Z-axis direction. An X-axis driving mechanism $W_2$ moves the respective ink pans 13*k*, 13*c*, 13*m*, and 13*y* in the X-axis direction.

In a recording operation, the respective recording heads 12*k*, 12*c*, 12*m*, and 12*y* discharge the inks 2 of the respective colors K, C, M, and Y. As a result, the recording medium is spotted with the inks 2 of the respective colors, thereby recording the image on the recording medium.

The maintenance step $F_1$ depicted in FIG. 4 represents an arrangement of the respective recording heads 12*k*, 12*c*, 12*m*, and 12*y* and the respective ink pans 13*k*, 13*c*, 13*m*, and 13*y* in the recording operation. The respective ink pans 13*k*, 13*c*, 13*m*, and 13*y* are arranged between the respective recording heads 12*k*, 12*c*, 12*m*, and 12*y*.

Then, when the maintenance operation begins, as represented by the maintenance step $F_2$, the elevating mechanism $W_1$ moves down the respective ink pans 13*k*, 13*c*, 13*m*, and 13*y*. The respective ink pans 13*k*, 13*c*, 13*m*, and 13*y* move down to reach predetermined positions below the respective protruding members 19 of the respective recording heads 12*k*, 12*c*, 12*m*, and 12*y*. At this time, the elevating mechanism $W_1$ stops downward movement of the respective ink pans 13*k*, 13*c*, 13*m*, and 13*y*.

Then, at the maintenance step $F_3$, the X-axis driving mechanism $W_2$ moves the respective ink pans 13*k*, 13*c*, 13*m*, and 13*y* in the X-axis direction. When the respective ink pans 13*k*, 13*c*, 13*m*, and 13*y* reach positions where they face the respective recording heads 12*k*, 12*c*, 12*m*, and 12*y*, the X-axis driving mechanism $W_2$ stops movement in the X-axis direction.

Subsequently, at the maintenance step $F_4$, the elevating mechanism $W_1$ moves up the respective ink pans 13*k*, 13*c*, 13*m*, and 13*y* in the Z-axis direction by a predetermined distance. As a result, the respective head cap portions 15*k*, 15*c*, 15*m*, and 15*y* in the ink pans 13*k*, 13*c*, 13*m*, and 13*y* come into contact with the respective recording heads 12*k*, 12*c*, 12*m*, and 12*y*.

Figure 5:
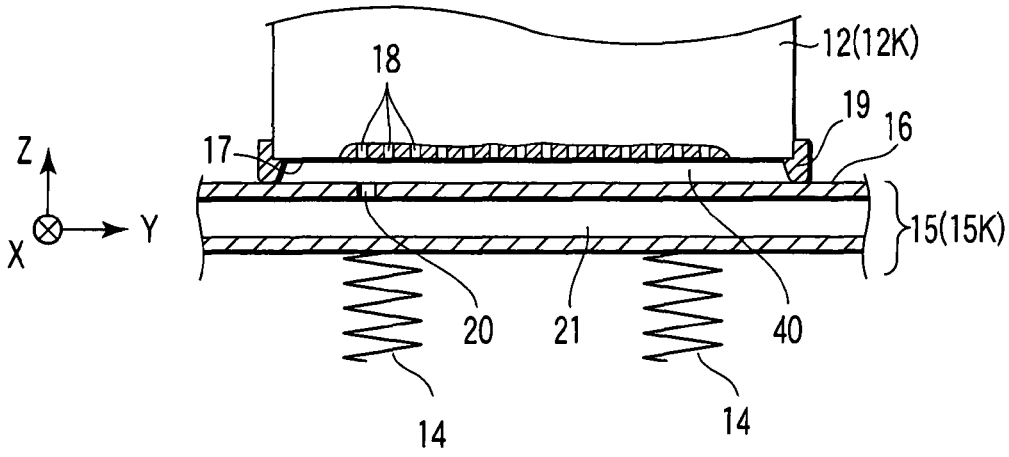
FIG. 5 is a view showing a state where the head cap portion is in contact with the recording head in the apparatus.

FIG. 5 shows a state where, e.g., the head cap portion 15*k* is in contact with the recording head 12*k*. The flat surface portion 16 of the head cap portion 15*k* comes into contact with the protruding portion 19 provided on the entire periphery of the outer rim of the nozzle surface 17 of the recording head 12*k*. At this time, the flat surface portion 16 of the head cap portion 15*k* is pressed against the protruding portion 19 of the recording head 12*k* by an urging force of each elastic member 14. The protruding portion 19 is formed of an elastic member. The flat surface portion 16 is formed of a rigid body. As a result, the protruding member 19 is appressed against the flat surface portion 16 of the head cap portion 15*k*.

Consequently, the nozzle surface 17 of the recording head 12*k*, the protruding member 19, and the flat surface portion 16 form the hermetically closed space 40. As a result, each nozzle 18 of the recording head 12*k* is covered with the hermetically closed space 40. That is, each nozzle 18 of the recording head 12*k* is capped with the head cap portion 15*k*.

In this state, the electromagnetic valve 23 and the electromagnetic valve 47 are respectively closed. Then, the suction pump 25 draws air. A negative pressure is formed in the suction chamber 24 by the air drawing operation. When the inside of the suction chamber 24 reaches a fixed negative pressure value, the electromagnetic valve 23 is opened. At this time, the air drawing operation of the suction pump 25 stops. The inside of the hermetically closed space 40 communicates with the suction chamber 24 from the suction hole 20 through the suction path 21 and the suction tube 22 at the moment of opening the electromagnetic valve 23. Therefore, a negative pressure is precipitously formed in the hermetically closed space 40. As a result, the negative pressure is precipitously applied to each nozzle 18 of the recording head 12*k*.

Consequently, the ink in each nozzle 18 is drawn, and foreign particles, e.g., dust, ink having an increased viscosity degree, or ink including air bubbles lodging in each nozzle 18 are drawn. These foreign particles are supplied from the hermetically closed space 40 to the suction chamber 24 via the suction hole 20, the suction path 21, and the suction tube 22.

When removal of the foreign particles in each nozzle 18 of the recording head 12*k* is finished, an operation is performed in the order opposite to the order of the maintenance steps $F_1$ to $F_4$. That is, the elevating mechanism $W_1$ moves down the respective ink pans 13*k*, 13*c*, 13*m*, and 13*y*. When they reach predetermined positions, the elevating mechanism $W_1$ stops downward movement of the ink pans 13*k*, 13*c*, 13*m*, and 13*y*.

Then, the X-axis driving mechanism $W_2$ moves the respective ink pans 13*k*, 13*c*, 13*m*, and 13*y* in a negative X-axis direction. The respective ink pans 13, 13*c*, 13*m*, and 13*y* stop at positions deviating from the lower spaces of the recording heads 12*k*, 12*c*, 12*m*, and 12*y*.

Then, the elevating mechanism $W_1$ moves up the respective ink pans 13$k$, 13$c$, 13$m$, and 13$y$ to be arranged between the respective recording heads 12$k$, 12$c$, 12$m$, and 12$y$. It is to be noted that the head cap portions are moved in this embodiment, but the present invention is not restricted thereto. The recording heads may be moved, or both the head caps and the recording heads may be moved.

As explained above, according to the first embodiment, the protruding member 19 formed of an elastic member is provided on the entire periphery of the outer rim of the nozzle surface 17 of each recording head 12, and the head cap portion 15 having the flat surface portion 16 formed of a rigid body is provided. As a result, the flat surface portion 16 of the head cap portion 15 is brought into contact with the protruding member 19 provided on the recording head 12 side. Therefore, even if the protruding member 19 and the flat surface portion 16 of the head cap portion 15 are not positioned, the flat surface portion 16 of the head cap portion 15 can be assuredly brought into contact with the protruding member 19. Therefore, the flat surface portion 16 of the head cap portion 15 can be assuredly brought into contact with the protruding member 19 without requiring a complicated positioning mechanism.

The nozzle surface 17 of the recording head 12, the protruding member 19, and the flat surface portion 16 form the hermetically closed space 40. As a result, each nozzle 18 of the recording head 12 can be assuredly capped.

When the suction pump 25 draws air in a state where each nozzle 18 of the recording head 12 is capped, foreign particles in each nozzle 18 can be removed.

The protruding member 19 can be formed of an elastic member. For example, when a special ink is used, a very expensive rubber, e.g., a fluorocarbon rubber (especially, perfluoro) or phlorosilicon must be used for the protruding member 19 to cope with the special ink in some cases. In such a case, the protruding member 19 can be formed with a very small amount of such a material. As a result, a design can be realized with a suppressed cost.

Various kinds of materials or coating processing can be used for the head cap portion 15. For example, ink-shedding processing can be applied to the upper side of the flat surface portion 16 of the head cap portion 15. As a result, the ink 2 does not stay on the flat surface portion 16 of the head cap portion 15. Therefore, at the time of capping based on bringing the head cap portion 15 into contact with the recording head 12, the ink 2 with an increased viscosity degree does not adhere to the recording head 12 from the head cap portion 15.

The present invention is not restricted to the first embodiment, and may be modified as follows. It is to be noted that like reference numbers denote parts to the same as those in FIG. 2, thereby omitting an explanation thereof.

Figure 6A:
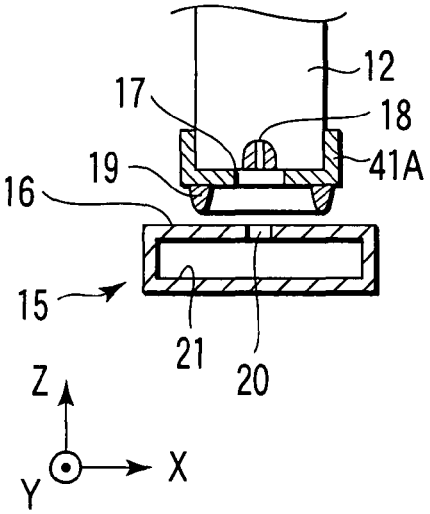
FIG. 6A is a block diagram of a front surface side showing a first modification of a recording head and a head cap portion in the apparatus.
Figure 6B:
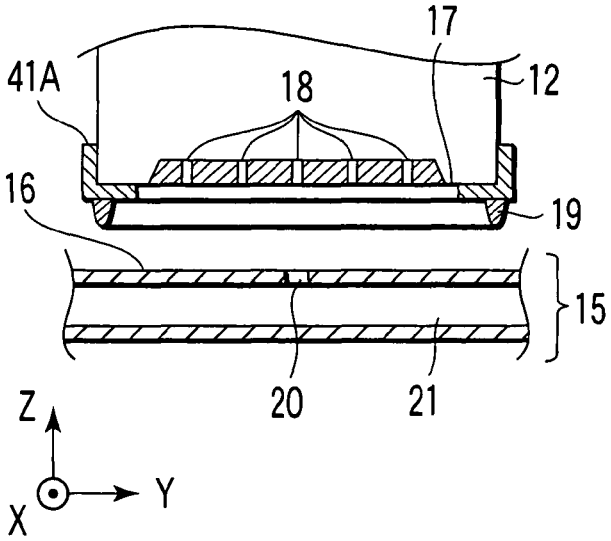
FIG. 6B is a block diagram of side surfaces of the recording head and the head cap portion in the apparatus.

FIG. 6A is a block diagram of a front surface side showing a first modification of the recording head 12 and the head cap portion 15. FIG. 6B is a block diagram of side surface of the recording head 12 and the head cap portion 15. The first modification is different from the first embodiment in that a plate 41A is provided as a collateral member on the recording head 12. This modification is also different from the first embodiment in that the protruding member 19 is provided on the recording head 12 via the plate 41A. Other structures are the same as those in the first embodiment.

The plate 41A is provided to cover the nozzle surface 17. The plate 41A protects the nozzle 18. The protruding member 19 is provided over an entire periphery of an outer rim of the plate 41A.

In such a configuration, the head cap portion 15 is brought into contact with the protruding member 19. As a result, the flat surface portion 16 of the head cap portion 15 is pressed against the protruding member 19 by an urging force of each elastic member 14. Therefore, the nozzle surface 17 of the recording head 12, the protruding member 19, the flat surface portion 16, and the plate 41A form a hermetically closed space. Even if the protruding member 19 is disposed to the plate 41A provided to protect the nozzle 18 in this manner, the same function and effect as those in the first embodiment can be obtained.

Figure 7A:
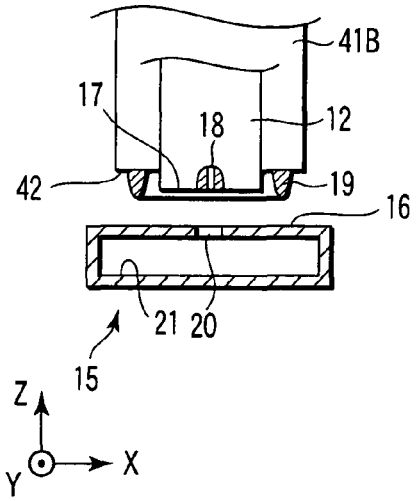
FIG. 7A is a block diagram of a front surface side showing a second modification of a recording head and a head cap portion in the apparatus.
Figure 7B:
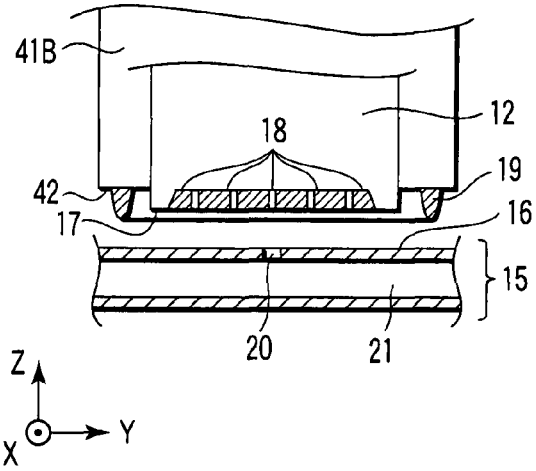
FIG. 7B is a block diagram of side surfaces of the recording head and the head cap portion.

FIG. 7A is a block diagram of a front surface side showing a second modification of the recording head 12 and the head cap portion 15. FIG. 7B is a block diagram of side surfaces of the recording head 12 and the head cap portion 15. The second modification is different from the first embodiment in that a support member 41B as a collateral member that supports the recording head 12 is provided. This modification is also different from the first embodiment in that the protruding portion 19 is provided on a bottom surface portion 42 of the support member 41B. Other structures are the same as those in the first embodiment.

The support member 41B supports the nozzle surface 17 of the recording head 12 in a state where it slightly protrudes beyond the bottom surface portion 42. The protruding member 19 is provided over an entire periphery of the bottom surface portion 42 of the support member 41B.

In such a configuration, the head cap portion 15 is brought into contact with the protruding member 19. As a result, the flat surface portion 16 of the head cap portion 15 is pressed against the protruding member 19 by an urging force of each elastic member 14. Therefore, the nozzle surface 17, the protruding member 19, the flat surface portion 16, and the bottom surface portion 42 form a hermetically closed space.

In this manner, the protruding member 19 is disposed to the support member 41B that supports the recording head 12. As a result, the second modification can obtain the same function and effect as those in the first embodiment. A risk of damaging the nozzle surface 17 can be avoided as compared with an example where the protruding member 19 is disposed to the recording head 12.

Figure 8A:
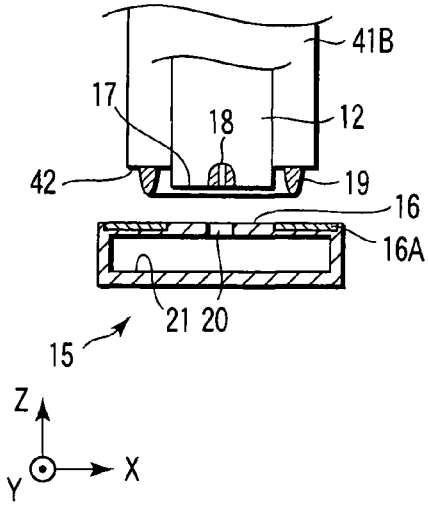
FIG. 8A is a block diagram of a front surface side showing a third modification of a recording head and a head cap portion in the apparatus.
Figure 8B:
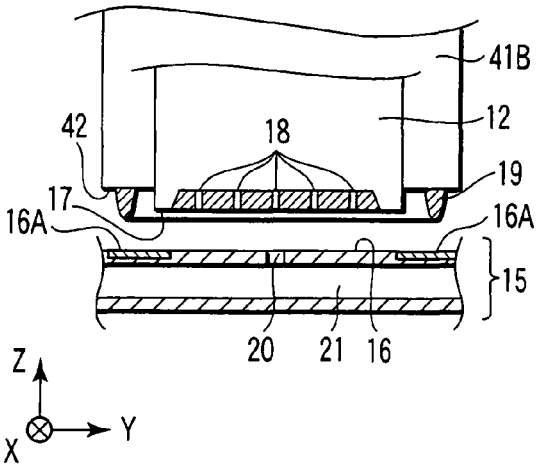
FIG. 8B is a block diagram of side surfaces of the recording head and the head cap portion.

FIG. 8A is a block diagram of a front surface side showing a third modification of the recording head 12 and the head cap portion 15. FIG. 8B is a block diagram of side surfaces of the recording head 12 and the head cap portion 15. The third modification is different from the first embodiment in that a support member 41B as a collateral member that supports the recording head 12 is provided. This modification is also different from the first embodiment in that the protruding member 19 formed of a rigid body is provided on a bottom surface portion 42 of the support member 41B. Further, a part of the flat surface portion 16 of the head cap portion 15 is formed of an elastic member 16A. Other structures are the same as those in the first embodiment.

The support member 41B supports the nozzle surface 17 of the recording head 12 in a state where it slightly protrudes beyond the bottom surface portion 42. The protruding member 19 is provided over an entire periphery of the bottom surface portion 42 of the support member 41B.

The elastic member 16A is provided in accordance with a position of the protruding member 19. The elastic member 16A is formed on the same plane with the flat surface portion 16 of the head cap portion 15. The elastic member 16A is formed to have an area wider than that of a region where the protruding member 19 is provided. As a result, the elastic member 16A is formed to have the area that enables contact with the protruding member 19.

In such a configuration, the head cap portion 15 is brought into contact with the protruding member 19. As a result, the elastic member 16A of the head cap portion 15 is pressed against the protruding member 19 by an urging force of each elastic member 14. Since the protruding member 19 is formed of the rigid body, it pushes in the elastic member 16A to be contracted. Consequently, the nozzle surface 17, the protruding member 19, the elastic member 16A of the flat surface portion 16, and the bottom surface portion 42 form a hermetically closed space.

In this manner, the protruding member 19 formed of the rigid body is provided with respect to the support member 41B that supports each recording head 12. Further, a part of the flat surface portion 16 is formed of the elastic member 16A. As a result, the third modification can obtain the same function and effect as those in the first embodiment. Further, the protruding member 19 is formed of the rigid body, and a part of the flat surface portion 16 is formed of the elastic member 16A. Consequently, processing can be facilitated. Furthermore, a risk of damaging the nozzle surface 17 can be avoided as compared with an example where the protruding member 19 is provided on the recording head 12.

Figure 9A:
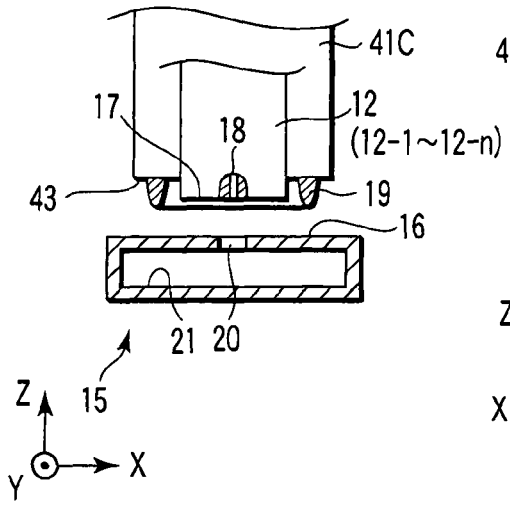
FIG. 9A is a block diagram of a front surface side showing a fourth modification of a recording head and a head cap portion in the apparatus.
Figure 9B:
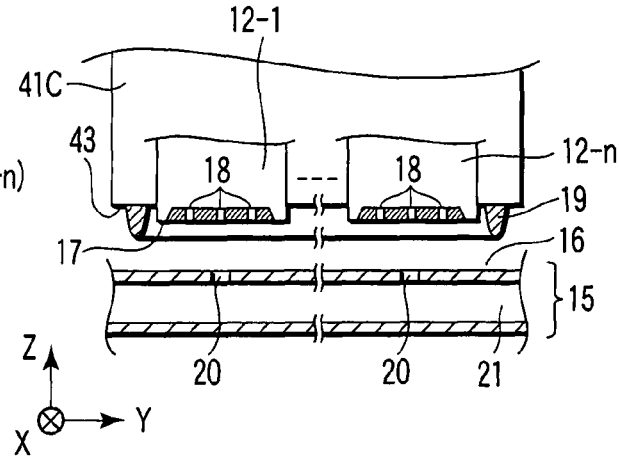
FIG. 9B is a block diagram of side surfaces of the recording head and the head cap portion.

FIG. 9A is a block diagram of a front surface side showing a fourth modification of the recording head 12 and the head cap portion 15. FIG. 9B is a block diagram of side surfaces of the recording head 12 and the head cap portion 15. The fourth modification is different from the first embodiment in that a support member 41C as a collateral member that collectively supports the plurality of recording heads 12 (12-1 to **12-*n*: n is an integer equal to or above 2) is provided. This modification is also different from the first embodiment in that the protruding member 19 is provided on a bottom surface portion 43 of the support member 41**C. Other structures are the same as those in the first embodiment.

The support member 41C supports the nozzle surfaces 17 of the plurality of recording heads 12-1 to **12-*n* in a state where they protrude slightly beyond the bottom surface 43. The protruding member 19 is provided over an entire periphery of the bottom surface portion 43 of the support member 41C. The protruding member 19 is provided to surround the plurality of recording heads 12-1 to 12-*n*. At least one suction hole 20 is formed in the flat surface portion 16 of the head cap portion 15**.

In such a configuration, the head cap portion 15 is brought into contact with the protruding member 19. As a result, the flat surface portion 16 of the head cap portion 15 is pressed against each protruding member 19 by an urging force of each elastic member 14. Consequently, the respective nozzle surfaces 17 of the recording heads 12-1 to **12-*n*, the protruding member 19, the flat surface portion 16, and the bottom surface portion 43** form a hermetically closed space.

Even if the protruding member 19 is provided on the support member 41C that supports the plurality of recording heads, the fourth modification can obtain the same function and effect as those in the first embodiment. Moreover, the protruding member 19 does not have to be provided in accordance with each of the recording heads, and hence the plurality of recording heads can be collectively subjected to a maintenance operation. The fourth modification can avoid a risk of damaging the nozzle surfaces 17 as compared with an example where the protruding member 19 is provided on the recording head 12.

Figure 10A:
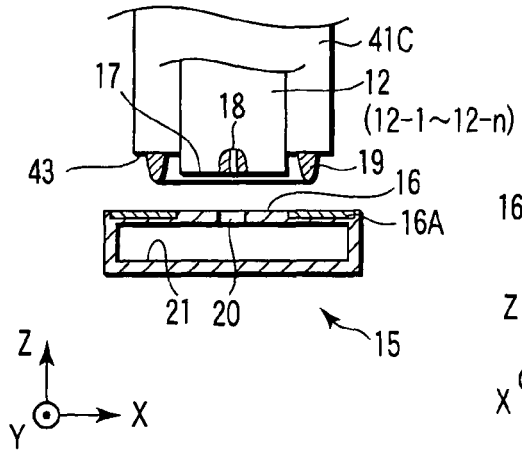
FIG. 10A is a block diagram of a front surface side showing a fifth modification of a recording head and a head cap portion in the apparatus.
Figure 10B:
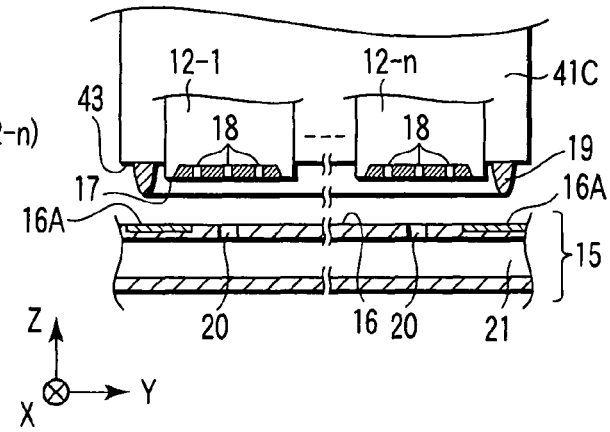
FIG. 10B is a block diagram of side surfaces of the recording head and the head cap portion.

FIG. 10A is a block diagram of a front surface side showing a fifth modification of the recording head 12 and the head cap portion 15. FIG. 10B is a block diagram of side surfaces of the recording head 12 and the head cap portion 15. The fifth modification is different from the first embodiment in that a support member 41C as a collateral member that collectively supports the plurality of recording heads 12 (12-1 to **12-*n*: n is an integer that is equal to or above 2) is provided. This modification is also different from the first embodiment in that the protruding member 19 formed of a rigid body is provided on a bottom surface portion 43 of the support member 41C. Additionally, this modification is different from the first embodiment in that a part of the flat surface portion 16 of the head cap portion 15 is formed of an elastic member 16**A. Other structures are the same as those in the first embodiment.

The support member 41C supports the nozzle surfaces 17 of the plurality of recording heads 12-1 to **12-*n* in a state where they slightly protrude beyond the bottom surface portion 43. The protruding member 19 is provided over an entire periphery of the bottom surface portion 43 of the support member 41C. The protruding member 19 is provided to surround the plurality of recording heads 12-1 to 12-*n*. The elastic member 16A is provided in accordance with a position of the protruding member 19. The elastic member 16A is formed on the same plane as the flat surface portion 16 of the head cap portion 15. The elastic member 16A is formed to have an area larger than an area of a region where the protruding member 19 is provided. As a result, the elastic member 16A is formed to have the area that allows contact with the protruding member 19**.

In such a configuration, the head cap portion 15 is brought into contact with the protruding member 19. As a result, the elastic member 16A of the head cap portion 15 is pressed against the protruding member 19 by an urging force of each elastic member 14. Since the protruding member 19 is formed of the rigid body, it pushes in the elastic member 16A to be contracted. As a result, the respective nozzle surfaces 17 of the recording heads 12-1 to **12-*n*, the protruding member 19, the elastic member 16A of the flat surface portion 16, and the bottom surface portion 43** form a hermetically closed space.

The protruding member 19 formed of the rigid body is provided with respect to the support member 41C that supports the plurality of recording heads 12-1 to **12-*n* in this manner, and a part of the flat surface portion 16 is formed of the elastic member 16A. As a result, the fifth modification can obtain the same function and effect as those in the first embodiment. The protruding member 19 does not have to be provided in accordance with each of the recording heads 12-1 to 12-*n*. The plurality of recording heads 12-1 to 12-*n* can be collectively subjected to a maintenance operation. Since the protruding member 19 is formed of the rigid body and a part of the flat surface portion 16 is formed of the elastic member 16A, processing can be facilitated. A risk of damaging the nozzle surfaces 17 can be avoided as compared with an example where the protruding member 19 is provided on each recording head 12**.

The protruding member 19 in the first embodiment and each modification can be modified in the following manner.

Figure 11:
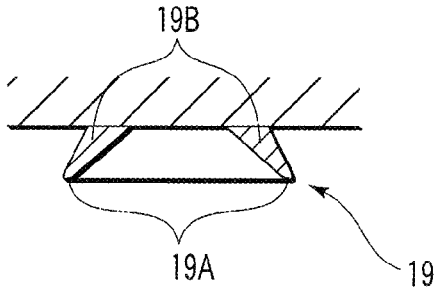
FIG. 11 is a block diagram showing a modification of a protruding member in the apparatus.

The protruding member 19 is formed of an elastic member. As shown in FIG. 11, the protruding member 19 is obtained by integrally forming an opening portion 19A and a base portion 19B. The base portion 19B is provided on the recording head 12.

As shown in FIG. 11, the protruding member 19 may be formed into a shape in which the opening portion 19A becomes wider than the base portion 19B. That is, the protruding member 19 is formed in such a manner that an opening aperture is gradually increased from the base portion 19B toward the opening portion 19A.

Figure 12:
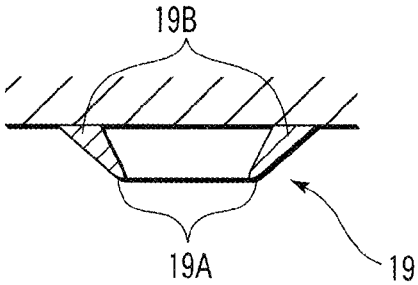
FIG. 12 is a block diagram showing a modification of the protruding member in the apparatus.
Figure 15:
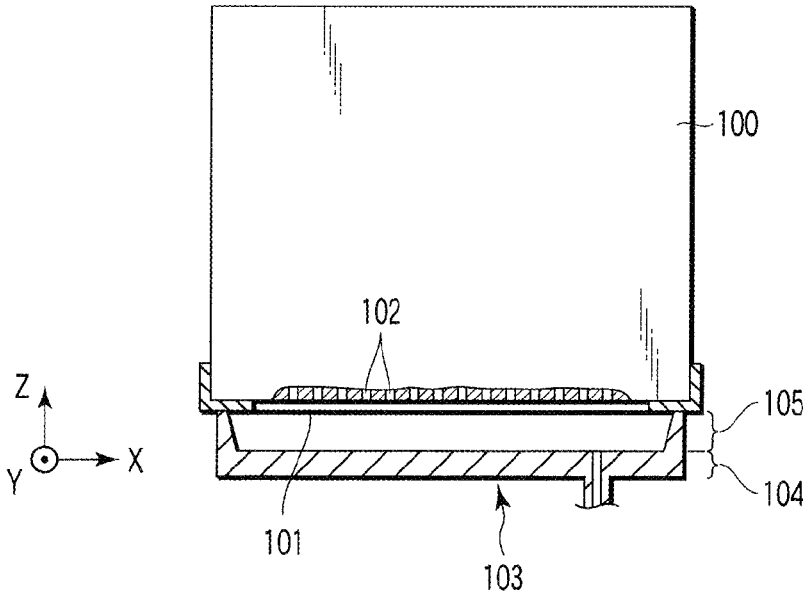
FIG. 15 PRIOR ART
FIG. 15 is a view showing a cap member with respect to a recording head in a conventional example.

As shown in FIG. 12, the protruding member 19 may be formed into a shape where the opening portion 19A is narrower than the base portion 19B. That is, the protruding member 19 is formed in such a manner that an opening aperture is gradually decreased from the base portion 19B toward the opening portion 19A.

When the protruding member 19 is formed in this manner, adhesion of the protruding member 19 with respect to the flat surface portion 16 can be improved.

Figure 13A:
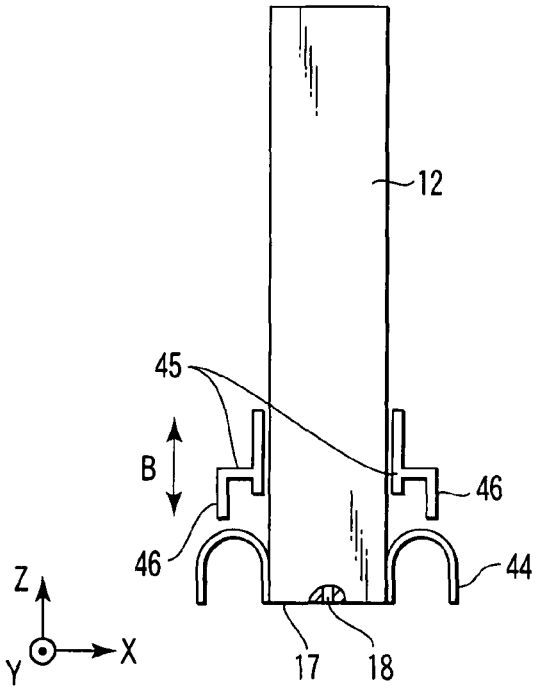
FIG. 13A is a block diagram of the recording head having a movable protruding member provided thereto in the apparatus.

On the other hand, a protruding member provided on the recording head 12 side may be movably provided. FIG. 13A is a block diagram of the recording head 12 having a movable protruding member provided thereon. A lip portion 44 as the protruding member is provided at a lower portion of the recording head 12. A cross section of the lip portion 44 is formed into a curved semi-cylindrical shape. The lip portion 44 is provided on an entire periphery at the lower portion of the recording head 12. The lip portion 44 is formed of, e.g., an elastic member.

A movable member 45 is provided on a side surface of the recording head 12. The movable member 45 is provided to be slidable with respect a side surface of the recording head 12 in a direction indicated by an arrow B. The movable member 45 has a pressing portion 46 formed into a hook-like shape. The pressing portion 46 comes into contact with a substantially top part of the lip portion 44 formed into the semi-cylindrical shape.

Figure 13B:
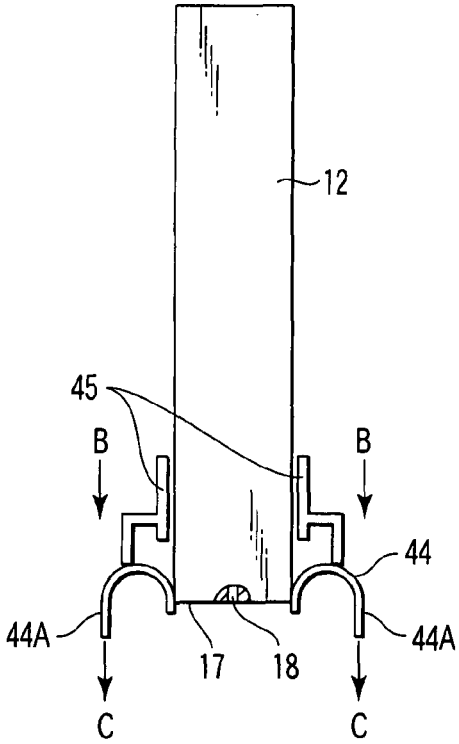
FIG. 13B is a block diagram of the recording head having the movable protruding member provided thereto during maintenance of the recording head in the apparatus.

When such a configuration is adopted, the movable member 45 slides along the side surface of the recording head 12 in the downward direction indicated by the arrow B at the time of, e.g., maintenance of the recording head 12 as shown in FIG. 13B. As a result, the movable member 45 comes into contact with the substantially top part of the lip portion 44 to press down the lip portion 44. The lip portion 44 has one side part fixed on the side surface of the recording head 12. As a result, the other side part 44A of the lip portion 44 moves in a direction indicated by an arrow C with the one side part being used as a supporting point. The lip portion 44 protrudes ahead of the nozzle surface 17 of the recording head 12.

In this state, the head cap portion 15 is brought into contact with the recording head 12. As a result, the flat surface portion 16 of the head cap portion 15 comes into contact with the lip portion 44 on the recording head 12 side. The flat surface portion 16 of the head cap portion 15 is pressed against the lip portion 44 on each recording head 12 side by an urging force of each elastic member 14. Consequently, the nozzle surface 17 of each recording head 12, the lip portion 44, and the flat surface portion 16 form a hermetically closed space.

When maintenance of each recording head 12 is finished, the movable member 45 slides in a direction opposite to a direction indicated by an arrow B depicted in FIG. 13B to be retracted to its original position shown in FIG. 13A. As a result, the lip portion 44 is restored to its original shape having the same height (position) as the nozzle surface 17 from the state where the other side part 44A protrudes ahead of the nozzle surface 17 of the recording head 12.

Even if the lip portion 44 as the movable protruding member is provided, the same function and effect as those in the first embodiment can be obtained. When the lip portion 44 as the protruding member is movably provided, the protruding member can be set to protrude ahead of the nozzle surface 17 during maintenance, and set at the same height (position) as the nozzle surface during image recording. As a result, during image recording, it is possible to eliminate an influence of occurrence of, e.g., jam caused when a recording medium comes into contact with the protruding member. Since the protruding member is set at the same height as the nozzle surface during image recording, the nozzle surface can further approximate the recording medium, thus avoiding a spotting dislocation.

Figure 14A:
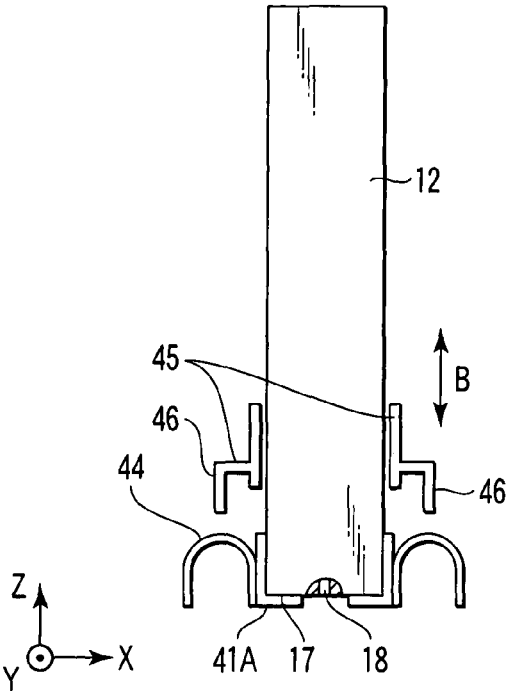
FIG. 14A is a block diagram showing another modification of a recording head having a movable protruding member provided thereto in the apparatus.

FIG. 14A is a block diagram of another modification of the recording head 12 having a movable protruding member provided thereon. It is to be noted that like reference numbers denote parts the same as those in FIGS. 13A and 13B, thereby omitting an explanation thereof. A plate 41A as a collateral member is provided at an outer rim of a bottom part of the recording head 12. The lip portion 44 as the protruding member is provided on a side surface of the plate 41A.

Figure 14B:
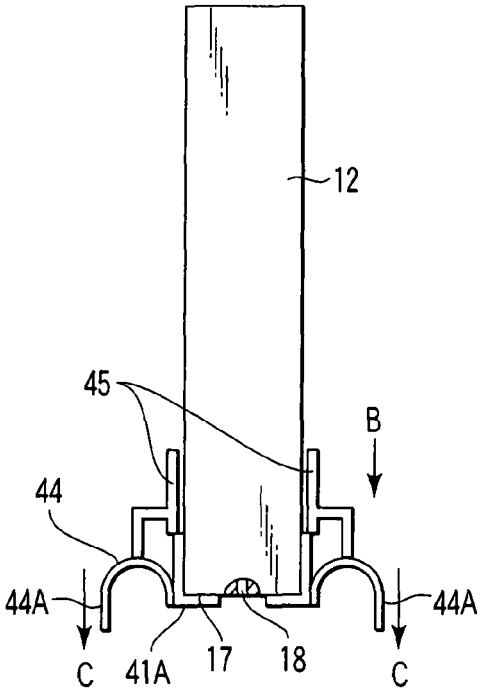
FIG. 14B is a block diagram of another modification of the recording head having the movable protruding member provided thereto during maintenance of the recording head in the apparatus.

When such a configuration is adopted, the movable member 45 slides in a direction indicated by an arrow B as shown in FIG. 14B. One side part of the lip portion 44 is fixed on the plate 41A. As a result, the other side part 44A of the lip portion 44 moves in a direction indicated by an arrow C with the one side part being used as a supporting point. Consequently, the other side part 44A of the lip portion 44 protrudes ahead of the nozzle surface 17 of the recording head 12. When the movable member 45 slides in a direction opposite to the direction indicated by the arrow B depicted in FIG. 14B, the lip portion 44 is restored to its original shape.

When the recording head 12 having the protruding member shown in one of FIGS. 6A to 14B and the head cap portion 15 are used, likewise, it is possible to remove foreign particles, e.g., ink in each nozzle 18, dust, ink having a high viscosity degree, or ink including air bubbles by applying a precipitous negative pressure to each nozzle in the recording head 12.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. An ink jet recording apparatus comprising:

a recording head having a plurality of nozzles that discharge ink;

a support member which supports the recording head;

a protruding member provided on the support member; and a droplet receiving portion which comprises a contact portion that comes into contact with the protruding member, and which receives the ink dropping from the recording head;

wherein the ink jet recording apparatus is adapted to form a hermitically closed space covering the plurality of nozzles by contacting the protruding member to the contact portion.

2. The ink jet recording apparatus according to claim 1, wherein the support member supports a plurality of recording heads.

3. The ink jet recording apparatus according to claim 2, wherein the protruding member is provided to surround the plurality of recording heads.

4. The ink jet recording apparatus according to claim 3, wherein the protruding member is formed of an elastic member, and at least the contact portion of the droplet receiving portion is formed of a rigid body.

5. The ink jet recording apparatus according to claim 3, wherein the protruding member is formed of a rigid body, and at least the contact portion of the droplet receiving portion is formed of an elastic member.

6. The ink jet recording apparatus according to claim 1, wherein the protruding member is formed of an elastic member, and at least the contact portion of the droplet receiving portion is formed of a rigid body.

7. The ink jet recording apparatus according to claim 1, wherein the protruding member is formed of a rigid body, and at least the contact portion of the droplet receiving portion is formed of an elastic member.

8. The ink jet recording apparatus according to claim 1, wherein the protruding member is provided to surround only one said recording head.

9. The ink jet recording apparatus according to claim 8, wherein the protruding member is formed of an elastic member, and at least the contact portion of the droplet receiving portion is formed of a rigid body.

10. The ink jet recording apparatus according to claim 8, wherein the protruding member is formed of a rigid body, and at least the contact portion of the droplet receiving portion is formed of an elastic member.

11. The ink jet recording apparatus according to claim 1, further comprising:

a maintenance mechanism that moves at least one of the support member and the droplet receiving portion and brings the protruding member provided on the support member into contact with the contact portion of the droplet receiving portion at a time of maintenance of the recording head.

12. An ink jet recording apparatus comprising:

a recording head having a plurality of nozzles that discharge ink;

a protruding member provided on the recording head; and a droplet receiving portion which comprises a contact portion that comes into contact with the protruding member, and which receives the ink dropping from the recording head;

wherein the ink jet recording apparatus is adapted to form a hermetically closed space covering the plurality of nozzles by contacting the protruding member to the contact portion; and wherein the protruding member includes a base portion provided on the recording head and an opening portion integrally formed with the base portion, and the protruding member is formed to expand or narrow along a direction from the base portion toward the opening portion.

13. An ink jet recording apparatus comprising:

a recording head having a plurality of nozzles that discharge ink;

a protruding member provided on the recording head; and a droplet receiving portion which comprises a contact portion that comes into contact with the protruding member, and which receives the ink dropping from the recording head;

wherein the ink jet recording apparatus is adapted to form a hermetically closed space covering the plurality of nozzles by contacting the protruding member to the contact portion; and wherein the protruding member is formed of an elastic member, and at least the contact portion of the droplet receiving portion is formed of a rigid body.

14. The ink jet recording apparatus according to claim 13, wherein the protruding member is provided on a plate that protects a nozzle surface in which the plurality of nozzles are formed.

15. The ink jet recording apparatus according to claim 13, wherein the protruding member is formed into a continuous convex shape surrounding the plurality of nozzles in the recording head.

16. The ink jet recording apparatus according to claim 13, wherein the protruding member includes a base portion provided on the recording head and an opening portion integrally formed with the base portion, and the protruding member is formed to expand or narrow along a direction from the base portion toward the opening portion.

17. The ink jet recording apparatus according to claim 13, further comprising:

a maintenance mechanism that moves at least one of the recording head and the droplet receiving portion and brings the protruding member provided on the recording head into contact with the contact portion of the droplet receiving portion at a time of maintenance of the recording head.

18. An ink jet recording apparatus comprising:

a recording head having a plurality of nozzles that discharge ink;

a protruding member provided on the recording head; and a droplet receiving portion which comprises a contact portion that comes into contact with the protruding member, and which receives the ink dropping from the recording head;

wherein the ink jet recording apparatus is adapted to form a hermetically closed space covering the plurality of nozzles by contacting the protruding member to the contact portion; and wherein the protruding member is changeable to a state in which the protruding member protrudes ahead of the recording head and a state in which the protruding member is retracted to an original position at which it does not protrude ahead of the recording head.

19. The ink jet recording apparatus according to claim 18, wherein the protruding member is formed of an elastic member, and at least the contact portion of the droplet receiving portion is formed of a rigid body.

20. The ink jet recording apparatus according to claim 18, wherein the protruding member is formed of a rigid body, and at least the contact portion of the droplet receiving portion is formed of an elastic member.

21. The ink jet recording apparatus according to claim 18, further comprising:

a movable member provided to be slidable with respect to a side surface of the recording head;

wherein the recording head has a nozzle surface in which the nozzles are formed;

wherein the protruding member has curved semi-cylindrical shape in cross section and is provided on an entire periphery at a lower part of the recording head;

wherein the movable member is adapted to slide to push a substantially top part of the protruding member, to cause the protruding member to protrude ahead of the nozzle surface of the recording head; and wherein when the movable member pushes the substantially top part of the protruding member, the droplet receiving portion is brought into contact with the recording head while the protruding member protrudes ahead of the nozzle surface, and the plurality of nozzles are capped with the droplet receiving portion.

* * * * *